US008968054B2

(12) United States Patent
Wiesner et al.

(10) Patent No.: US 8,968,054 B2
(45) Date of Patent: Mar. 3, 2015

(54) METHOD FOR COOLING A WORKPIECE MADE OF SEMICONDUCTOR MATERIAL DURING WIRE SAWING

(75) Inventors: Peter Wiesner, Reut (DE); Anton Huber, Burghausen (DE)

(73) Assignee: Siltronic AG, Munich (DE)

( * ) Notice: Subject to any disclaimer, the term of this patent is extended or adjusted under 35 U.S.C. 154(b) by 523 days.

(21) Appl. No.: 13/340,719

(22) Filed: Dec. 30, 2011

(65) Prior Publication Data

US 2012/0178346 A1 Jul. 12, 2012

(30) Foreign Application Priority Data

Jan. 12, 2011 (DE) ..... 10 2011 008 400

(51) Int. Cl.
*B28D 1/06* (2006.01)
*B28D 5/00* (2006.01)
*B28D 1/08* (2006.01)

(52) U.S. Cl.
CPC ..... *B28D 5/0076* (2013.01); *B28D 1/08* (2013.01)
USPC ..... 451/54; 451/7; 125/21

(58) Field of Classification Search
CPC ..... B28D 1/08; B28D 5/0076
USPC ..... 451/7, 54; 125/21
See application file for complete search history.

(56) References Cited

U.S. PATENT DOCUMENTS

| | | | | |
|---|---|---|---|---|
| 4,655,191 | A | 4/1987 | Wells et al. | |
| 5,287,774 | A | 2/1994 | Seifert | |
| 5,771,876 | A | 6/1998 | Egglhuber | |
| 6,390,896 | B1 * | 5/2002 | Huber et al. | 451/59 |
| 6,602,834 | B1 * | 8/2003 | Ward et al. | 508/506 |
| 6,652,356 | B1 | 11/2003 | Ariga | |
| 6,889,586 | B2 * | 5/2005 | Kondo et al. | 125/13.01 |
| 8,267,742 | B2 * | 9/2012 | Kitagawa | 451/7 |
| 8,534,275 | B2 * | 9/2013 | Fukuda et al. | 125/16.02 |
| 2002/0174861 | A1 * | 11/2002 | Lundt et al. | 125/21 |
| 2006/0025051 | A1 * | 2/2006 | Noguchi et al. | 451/5 |
| 2008/0149085 | A1 | 6/2008 | Skovgaard-Soerensen | |
| 2009/0253352 | A1 | 10/2009 | Oishi et al. | |
| 2010/0163010 | A1 | 7/2010 | Kitagawa | |

FOREIGN PATENT DOCUMENTS

| | | | |
|---|---|---|---|
| CN | 100396460 | C | 6/2008 |
| CN | 201287408 | Y | 8/2009 |
| CN | 101633214 | A | 1/2010 |
| DE | 10122628 | A1 | 11/2002 |
| EP | 0522542 | A1 | 1/1993 |
| EP | 1097782 | B1 | 11/2006 |

(Continued)

*Primary Examiner* — Maurina Rachuba

(74) *Attorney, Agent, or Firm* — Leydig, Voit & Mayer, Ltd.

(57) ABSTRACT

A method for cooling a cylindrical workpiece during wire sawing includes applying a liquid coolant to a surface of the workpiece. The workpiece is made of semiconductor material having a surface including two end faces and a lateral face. The method includes sawing the workpiece with a wire saw including a wire web having wire sections arranged in parallel by penetrating the wire sections into the workpiece by an oppositely directed relative movement of the wire sections and the workpiece. Wipers are disposed so as to bear on the surface of the workpiece. The temperature of the workpiece is controlled during the wire sawing using a liquid coolant applied onto the workpiece above the wipers so as to remove the liquid coolant with the wipers bearing on the workpiece surface.

8 Claims, 2 Drawing Sheets

(56) References Cited

FOREIGN PATENT DOCUMENTS

| | | | |
|---|---|---|---|
| EP | 2070653 | A1 | 6/2009 |
| JP | 07040224 | A | 2/1995 |
| JP | 10180750 | A | 7/1998 |
| JP | 2005329506 | A | 12/2005 |
| JP | 2006150505 | A | 6/2006 |
| JP | 2007320011 | A | 12/2007 |
| JP | 2011-014561 | A | 1/2011 |
| JP | 2011083833 | A | 4/2011 |
| KR | 20080058170 | A | 6/2008 |

* cited by examiner

METHOD FOR COOLING A WORKPIECE MADE OF SEMICONDUCTOR MATERIAL DURING WIRE SAWING

CROSS REFERENCE TO RELATED APPLICATIONS

This application claims priority to German Patent Application No. DE 10 2011 008 400.2, filed on Jan. 12, 2011, which is hereby incorporated by reference herein in its entirety.

FIELD

The present invention relates to a method for cooling a cylindrical workpiece made of semiconductor material, for example silicon, germanium or gallium arsenide, during wire sawing, a liquid coolant being applied onto the semiconductor material workpiece by means of nozzles during the cutting.

BACKGROUND

For electronics, microelectronics and micro-electromechanics, semiconductor wafers with extreme requirements for global and local planarity, one-side referenced local planarity (nanotopography), roughness and cleanness are needed as starting materials (substrates). Semiconductor wafers are wafers of semiconductor materials, in particular compound semiconductors such as gallium arsenide and predominantly elementary semiconductors such as silicon and sometimes germanium. According to the prior art, semiconductor wafers are produced in a multiplicity of successive process steps: in a first step, for example, a single crystal (rod) of semiconductor material is pulled by the Czochralski method or a polycrystalline block of semiconductor material is cast, and in a further step the resulting circular-cylindrical or block-shaped workpiece of semiconductor material (ingot) is cut into individual semiconductor wafers by wire sawing.

Wire saws are used in order to cut a multiplicity of wafers from a workpiece made of semiconductor material. U.S. Pat. No. 5,771,876 describes the functional principle of a wire saw, which is suitable for the production of semiconductor wafers. The components of these wire saws include a machine frame, a forward feed device and a sawing tool, which consists of a web (wire web) of parallel wire sections.

In general, the wire web is formed by a multiplicity of parallel wire sections which are tensioned between at least two wire guide rollers, the wire guide rollers being rotatably mounted and at least one of them being a driven roller.

The wire sections may belong to a single finite wire, which is guided spirally around the roll system and is unwound from a stock roll onto a receiver roll. Patent specification U.S. Pat. No. 4,655,191, on the other hand, describes a wire saw in which a multiplicity of finite wires are provided and each wire section of the wire web is assigned to one of these wires. EP 522 542 A1 also describes a wire saw in which a multiplicity of endless wire loops run around the roll system.

The sawing wire may be covered with a cutting layer. When using wire saws having a sawing wire without firmly bound abrasive, abrasive in the form of a suspension (cutting suspension, sawing slurry, slurry) is supplied during the cutting process. During the cutting process, the workpiece passes through the wire web, in which the sawing wire is arranged in the form of wire sections lying parallel to one another. The passage through the wire web is brought about by means of a forward feed device, which moves the workpiece against the wire web, the wire web against the workpiece or the workpiece and the wire web against one another.

When cutting semiconductor wafers from a workpiece made of semiconductor material, it is conventional for the workpiece to be connected to a sawing strip into which the sawing wire cuts at the end of the process. The sawing strip is for example a graphite strip, which is adhesively bonded or cemented on the lateral face of the workpiece. The workpiece with the sawing strip is then cemented on a support body. After the cutting, the resulting semiconductor wafers remain fixed on the sawing strip like the teeth of a comb, and can thus be removed from the wire saw. Subsequently, the remaining sawing strip is separated from the semiconductor wafers.

The production of semiconductor wafers from workpieces made of semiconductor material, for example from circular-cylindrical single crystal rods or cuboid polycrystalline blocks, places great demands on the wire sawing. The aim of the sawing process is generally for each sawed semiconductor wafer to have side faces which are as plane as possible and lie parallel to one another. The so-called warp of the wafers is a known measure of the deviation of the actual wafer shape from the desired ideal shape. The warp should generally amount to at most a few micrometers (μm). It results from a relative movement of the sawing wire sections relative to the workpiece, which takes place in the axial direction with respect to the workpiece in the course of the sawing process. This relative movement may for example be caused by cutting forces which occurred during the sawing, axial displacements of the wire guide rolls due to thermal expansion, bearing plays or thermal expansion of the workpiece.

A significant amount of heat is released when the workpiece is cut by the abrasive, which in the course of the sawing process leads to heating of the workpiece and therefore to thermal expansion. This in turn leads not only to an increase of the warp, but also to significant waviness of the sawed wafers. A particularly strong temperature increase takes place over the first millimeters of the cut after cutting into the workpiece. With an increasing engagement length, the temperature of the workpiece increases further. In the region of the maximum engagement length, the workpiece temperature also reaches its maximum and subsequently decreases slightly, which besides the decreasing cutting heat is also attributable to the cooling fin effect of the resulting wafers. Workpiece temperature changes of +/−5° C. during the wire sawing have a negligible effect on the warp and the waviness, but cannot generally be achieved without additional outlay.

Since the workpiece is heated during the wire sawing process in order to produce semiconductor wafers, it needs to be cooled continuously during the sawing process in order to prevent thermally induced expansion of the workpiece and therefore to prevent a perturbing curvature of the cutting profile. Various methods for cooling the workpiece during wire sawing are known. In EP 2 070 653 A1, the cooling rate of the workpiece is monitored and an additional coolant (cooling slurry, slurry) is added when the cutting depth of the sawing wire is ⅔ or more of the diameter of the workpiece. EP 1097782 B1 and DE 10122628 A1 describe methods in which a thermally regulated coolant is applied onto the workpiece.

The disadvantage of the aforementioned methods is that the coolant flows into the region of the cut, where it is mixed with the cutting suspension. The choice of a suitable coolant is therefore greatly restricted, and it must have a similar composition to the cutting suspension. Even when using exactly the same media for the coolant and the cutting suspension, the problem remains that the coolant detrimentally affects the cutting behavior.

The detrimental effect is due to the fact that the temperature of the coolant for optimal cooling of the crystal must be at a different level from the temperature of the cutting suspension. However, the temperature of the cutting suspension is crucial for its viscosity, which determines the transport properties for the abrasive and therefore in turn affects the quality of the cut. The temperature of the cutting suspension is therefore usually regulated accurately, and optionally varied in a controlled way during the cutting. Particularly when using glycols as a carrier medium in the cutting suspension, there is a large temperature dependency of the viscosity.

Furthermore, the coolant flowing onto the cutting web also affects the temperature of the cutting suspension. This leads to an undesirable change of the wire web temperature, which results in a degradation of the quality of the cut.

US 2010/163010 A1 describes a method in which an attempt is made to avoid this problem. In this case, the coolant is alternately switched off and on so that the coolant is only applied onto the side of the workpiece on which the sawing wire leaves the workpiece. This is intended to prevent the coolant from being mixed directly with the sawing suspension which enters the sawing kerf. However, coolant still reaches the wire web and—albeit to a reduced extent—alters the thermal and mechanical conditions of the cut. In this method, it is necessary to use exactly the same medium for the coolant and the cutting suspension, since otherwise the cutting suspension would be uncontrollably modified.

JP 2005 329506 A2 describes a method in which a cooling gas is blown as a coolant onto the sawing wire. In this way, the viscosity of the cutting suspension can likewise be impaired and the quality of the cut degraded. Furthermore, gases are only very limitedly suitable for cooling since their relatively low heat capacity does not ensure sufficient dissipation of the amounts of heat usually produced during the cutting.

SUMMARY

An aspect of the invention is to develop a method which ensures optimal cooling during the wire sawing of a workpiece made of semiconductor material and at the same time does not affect the properties of the cutting suspension (sawing slurry, slurry).

In an embodiment, the present invention provides a method for cooling a cylindrical workpiece during wire sawing. The workpiece is made of semiconductor material having a surface including two end faces and a lateral face. The method includes sawing the workpiece with a wire saw including a wire web having wire sections arranged in parallel by penetrating the wire sections into the workpiece by an oppositely directed relative movement of the wire sections and the workpiece. Wipers are disposed so as to bear on a surface of the workpiece. The temperature of the workpiece is controlled during the wire sawing using a liquid coolant applied onto the workpiece above the wipers so as to remove the liquid coolant with the wipers bearing on the workpiece surface.

BRIEF DESCRIPTION OF THE DRAWINGS

Exemplary embodiments of the present invention are described in more detail below with reference to the drawings, in which.

DETAILED DESCRIPTION

In an embodiment, the present invention provides a method for cooling a cylindrical workpiece made of semiconductor material during wire sawing, the wire web consisting of wire sections arranged parallel penetrating into the workpiece during the sawing by an oppositely directed relative movement of the wire sections and the workpiece, and the temperature of the workpiece being controlled during the wire sawing by a liquid coolant, wherein wipers bear on the workpiece, the liquid coolant is applied onto the workpiece above the wipers bearing on the workpiece surface and the liquid coolant is removed from the workpiece surface by the wipers bearing on the workpiece. The method according to the invention also makes it possible to cool a crystal in such a way that the warp and nanotopography product properties of the resulting semiconductor wafers are improved. Furthermore, the method according to the invention makes it possible to use a coolant which can be selected independently of the cutting suspension.

A cylindrical workpiece is a geometrical body having a surface consisting of two parallel plane faces (end faces) and a lateral face, which is formed by parallel straight lines. In the case of a circular-cylindrical body, the end faces are round and the lateral face is convex. In the case of a cuboid cylindrical workpiece, the lateral face is plane.

Figure 1:
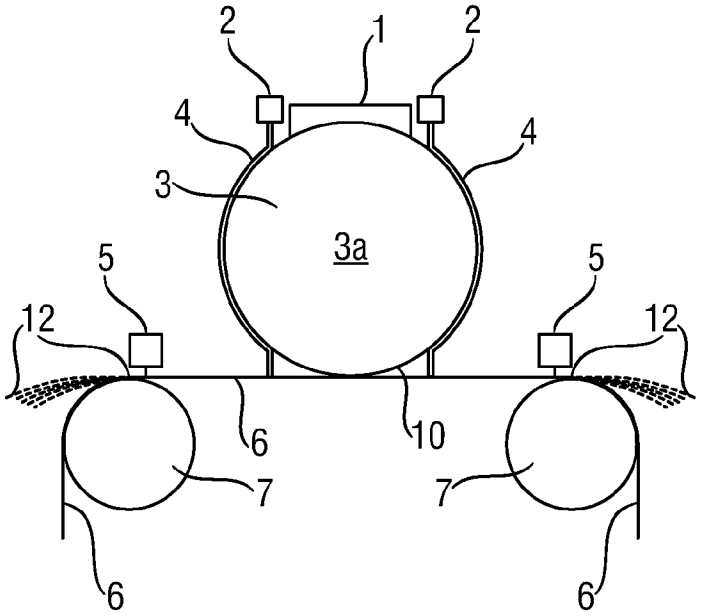
FIG. 1 shows a structure for sawing a circular-cylindrical workpiece made of a semiconductor material.

FIG. 1 shows a structure for sawing a circular-cylindrical workpiece made of semiconductor material without wipers. The designation of the objects represented in FIG. 1 is identical to the designation in FIG. 2, and will be discussed in the explanatory text for FIG. 2.

Figure 2:
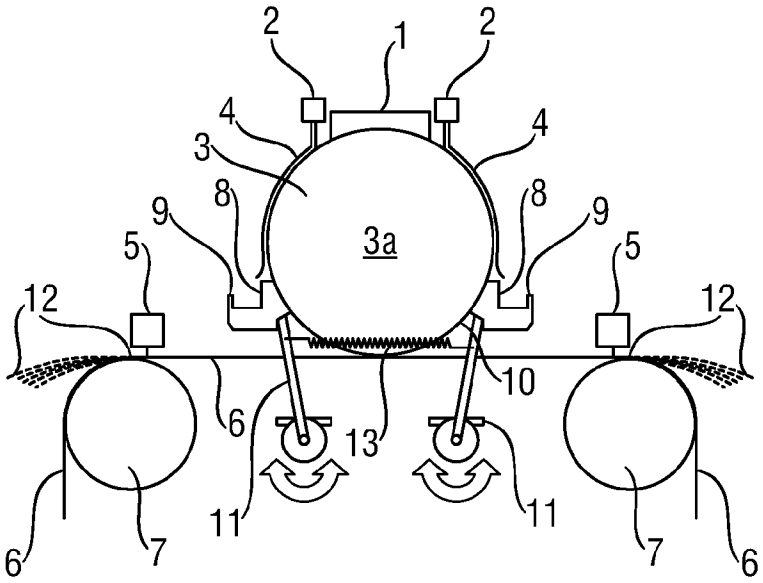
FIG. 2 shows a structure for sawing a workpiece in accordance with an embodiment of the present invention.

FIG. 2 shows the preferred basic structure of the method according to the invention with reference to the example of a circular-cylindrical workpiece made of semiconductor material.

An embodiment of the method according to the invention will be described below with the aid of FIG. 2:

A conventional wire saw can be used in a method according to an embodiment of the invention. The components of these wire saws include a machine frame, a forward feed device and a sawing tool, which consists of a web of parallel wire sections. The workpiece is generally fixed on a mounting plate and clamped with it in the wire saw.

In general, the wire web of the wire saw is formed by a multiplicity of parallel wire sections 6, which are tensioned between at least two (and optionally three, four or more) wire guide rolls 7, the wire guide rolls being rotatably mounted and at least one of the wire guide rolls being driven. The wire sections generally belong to a single finite wire, which is guided spirally around the roll system and is unwound from a stock roll onto a receiver roll.

A cutting suspension is applied by means of the nozzles 5 to the wire sections. The workpiece 3 to be sawed, having a lateral face 10 and two end faces 3*a*, is fastened by means of a sawing strip 1 on a holding device (not shown) so that the end faces 3*a* are aligned parallel with the wire sections 6. During the sawing process, the forward feed device induces an oppositely directed relative movement of the wire sections and the workpiece. As a consequence of this forward feed movement the wire, to which a sawing suspension is applied, works through the workpiece to form parallel sawing kerfs.

Both wire saws in which the sawing wire in the wire web contains firmly bound abrasives, for example diamond abrasive or silicon carbide, and wire saws in which the sawing wire does not have an abrasive layer and the cutting power is provided by a cutting suspension containing abrasives, which is applied onto the sawing wire during or before the sawing process, are suitable for the method according to the invention.

All suspensions are suitable as a cutting suspension. Cutting suspensions comprising glycol, oil or water as carrier material and silicon carbide as abrasive are preferably used.

All liquid media which have a heat capacity sufficient to dissipate the heat produced during the sawing process are suitable as a coolant. Suitable coolants are for example water, glycols, or cutting suspensions.

The cutting suspension which is used during the sawing process is preferably used as the coolant.

A medium having a high heat capacity, for example water, is also preferably used as the coolant.

The carrier medium for the cutting suspension (for example glycol, oil or water) is particularly preferably used as the coolant.

The wire sections 6 of the wire web preferably penetrate into the workpiece 3 below the application points of the wipers 8 during the sawing. The coolant 4 is applied through the nozzles 2 during the sawing process above the wiper system used in the method according to the invention, onto the lateral face 10 of the workpiece 3 on which the wipers 8 preferably also bear on both sides. The wiper system, preferably consisting of two wipers 8 and preferably a respective collection trough 9 bearing on each of the wipers 8, is guided by means of a fastening device consisting of holders 11 so that the two wipers 8 bear on the left and right (in relation to the workpiece axis) on the lateral face 10 during the sawing process until a defined horizontal cutting position of the wire web is reached in the workpiece 3 to be cut. The coolant 4 flowing over the lateral face 10 is removed into the respective collection troughs 9 by the wipers 8 bearing on the lateral face 10. This ensures that the coolant 4 is discharged during the sawing process and does not come in contact with the cutting suspension 12 and the wire sections 6 of the wire web which lie below the wipers.

In a preferred embodiment, the cooling of the workpiece begins before or at the start of cutting, that is to say at the time when the sawing wires 6 of the wire web come in contact with the surface of the workpiece 3.

The coolant 4 is preferably applied onto the lateral face 10 of the cylindrical workpiece 3 above the wiper system bearing on the lateral face 10 of the workpiece 3 during the sawing process.

In a likewise preferred configuration of the invention, the coolant 4 is applied onto the end faces 3*a* of the workpiece above the wiper system bearing on the end faces during the sawing process.

In another possible configuration of the invention, the sawing strip 1 is applied below the workpiece 3 and the wire web penetrates into the workpiece from above during the sawing. The wiper system, which in this embodiment lies below the wire web, removes the cutting suspension from the surface (either lateral face or end faces) of the workpiece in this embodiment, and thus prevents mixing with the coolant 4 which is guided onto the surface from below.

The fastening device for the wiper system may consist of preferably mobile holders 11 which, for example, can be tilted and/or moved horizontally with respect to the wire web.

The fastening device used in a preferred embodiment of the invention for the wiper system consists of two mobile (preferably tiltable) holders 11, which are preferably connected by means of a spring 13. On each of the ends of the two holders directed toward the workpiece, there is a wiper 8 and a collection trough 9 bearing on the wiper 8. The fastening device is firmly connected to the wire sawing device so that the vertical distance between the application points of the wipers 8 on the lateral face 10 or the end faces 3*a* and the wire web is constant until a defined, freely selectable horizontal cutting position or penetration depth of the wire web is reached in the workpiece to be sawed. The defined point may, for example, be reached when the wire sections 6 of the wire web cut into the sawing strip 1.

When the wire web cuts in the sawing strip 1, the development of heat by the cutting is already relatively small since the cutting length is short, and cooling is no longer necessary. In addition, the faces of the wafers which are generated up to this time by the sawing process act as cooling fins.

Until the defined point is reached, the wipers 8 bear on the lateral face 10 or the end faces 3*a* during the sawing process. When this defined point is reached, the application of the coolant 4 onto the lateral face 10 or the end faces 3*a* is ended and the wiper system is removed with the holders 11 from the lateral face 10 or the end faces 3*a*.

The removal of the wipers 8 on both sides from the lateral face 10 or the end faces 3*a* of the workpiece 3 is preferably carried out mechanically using a suitable end-stop device coupled to the forward feed movement of the wire web. The end-stop device preferably triggers folding of the wipers away from the lateral face 10 or the end faces 3*a* of the workpiece 3. Likewise preferably, the removal of the wipers on both sides from the lateral face 10 or the end faces 3*a* of the workpiece 3 is carried out on a rail extending horizontally with respect to the plane of the wire web.

Particularly preferably, the removal of the wipers 8 from the lateral face 10 or the end faces 3*a* of the workpiece 3 is carried out using sensor control with the aid of a servo motor.

The holders 11 of the wiper system are preferably designed (not represented in FIG. 2 for the sake of clarity) so as to ensure that even in the case of a circular-cylindrical workpiece 3 having a convex lateral face 10, the wipers 8 bear continuously on both sides of the lateral face 10 during the sawing process according to the prior art, until the defined point is reached, so as to ensure flow of the coolant 4 into the collection troughs 9 until removal of the wipers.

At the start of the sawing process, in the case of a circular-cylindrical workpiece 3 having a convex lateral face 10, the spacing of the two application points of the wipers 8 is smaller in comparison with the diameter of the workpiece 3, and it increases in the course of the sawing process up to the diameter of the workpiece 3 then decreases again (in relation to the diameter of the workpiece 3). When the defined point is reached, the wipers 8 together with the collection troughs 9 are removed from the lateral face 10. The continuous bearing of the wipers 8 on the convex lateral face 10, from the start of the sawing process until the defined point is reached, is preferably ensured by the tension force of the spring 13 and the design of the holders 11.

In the case of a block-shaped workpiece, in which the lateral face is formed by parallel straight lines that are perpendicular to the end faces, the holders 11 together with the spring 13 likewise ensure that during the sawing process, until the defined point is reached, the wipers 8 together with the collection troughs 9 bear on the lateral face 10 to which the coolant 4 is applied.

In a likewise preferred embodiment of the invention, the mobile (preferably tiltable) holders 11 are connected to the wire sawing device so that the holders can be moved parallel in the cutting direction of the wire sections 6 of the wire web, for example on a rail, in order for example to be able to compensate for different spacings of the application points of the wipers on the lateral face 10 during the sawing process.

Preferably, the bearing of the wipers 8 on the lateral face 10 or the end faces 3*a* of the workpiece 3 is ensured by the force of a spring 13.

In another preferred embodiment, the bearing of the wiper system is controlled by sensors. The movement of the holders 11 of the fastening device during the sawing process, which is dictated by the external shape of the workpiece to be sawed, is carried out mechanically by motors so that the wipers 8 bear with a constant pressure on the lateral face 10 or the end faces 3*a* during the sawing process until a defined point is reached.

A respective collection trough 9 preferably bears on each of the wipers 8, as represented in FIG. 2. Likewise preferred is a collection trough 9 which is located below the wiper but does not bear on the wiper 8. The medium flowing away by means of the wiper is preferably guided via a channel or a slope into the collection trough 9 in this embodiment.

The collection trough 9 is preferably designed so that no liquid medium contained in the collection trough 9 can emerge uncontrolledly. This may preferably be achieved by an outlet device (not represented in FIG. 2) integrated into the collection trough 9.

The coolant 4 preferably flowing away by means of the wipers 8 is collected in the collection troughs 9. The coolant 4 may if necessary be separated and fed through a regulated cooling circuit. In this case, the desired temperature of the coolant 4 is restored and the coolant 4 is applied again onto the lateral face 10 of the workpiece 3 through the nozzles 2. As an alternative, the coolant 4 may also be discharged from the collection troughs 9 into a storage container.

For the sawing process (cutting), a cutting suspension 12 is applied through the nozzles 5 onto the wire sections 6 of the wire web. The wire web is guided according to the prior art by means of the rolls 7 perpendicularly (vertically) with respect to the axis of the workpiece 3.

A cutting suspension which contains glycol as a carrier material and silicon carbide as an abrasive is particularly preferably used.

The length of the wiper 8 is preferably equal to or greater than the length of the lateral face 10 of the workpiece to be sawed. The wiper system is preferably placed so that the wiper 8 bears on the entire axial length of the workpiece to be sawed.

The length of the wiper 8 when it bears on the end faces 3*a* of the workpiece is preferably equal to or greater than the horizontal width of the end face of the workpiece to be sawed. The wiper system is preferably placed so that the wiper 8 bears on the entire horizontal width of the end face of the workpiece to be sawed.

The wiper 8 is preferably made of a soft material, for example a soft plastic or rubber, which does not cause any damage to the lateral face 10 or the end faces 3*a* and ensures good sealing.

A plastic or a rubber having a Shore A hardness of between 60 and 80 is preferably used.

In the likewise preferred embodiment in which the wipers 8 bear on the workpiece 3 with a constant pressure, a plastic or a rubber having a Shore A hardness of less than 60 is preferably used.

After the sawing, the semiconductor wafers sawed by the method according to the invention have a significantly more planar surface in relation to nanotopography than semiconductor wafers which have been sawed according to the prior art.

Figure 3:
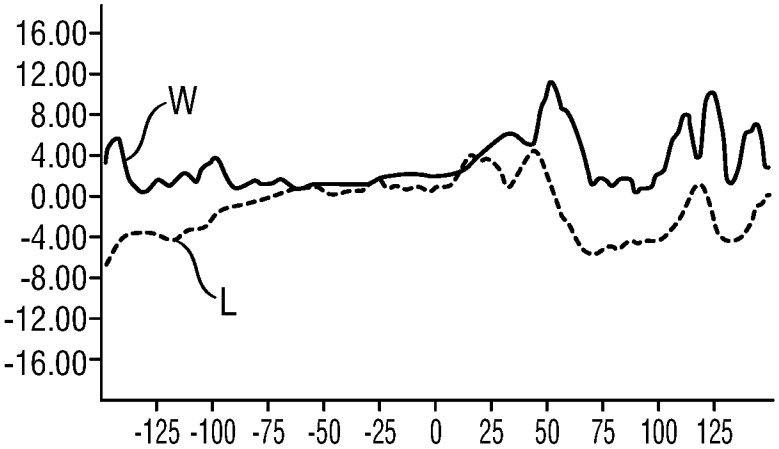
FIG. 3 shows a comparative example of the nanotopography parameters "waviness" (W) and "local warp" (L) of a semiconductor wafer.

FIG. 3 shows as an example the nanotopography parameters "waviness" (W) and "local warp" (L) for a semiconductor wafer having a diameter of 300 mm, which was produced according to the prior art by wire sawing from a crystal made of semiconductor material.

Figure 4:
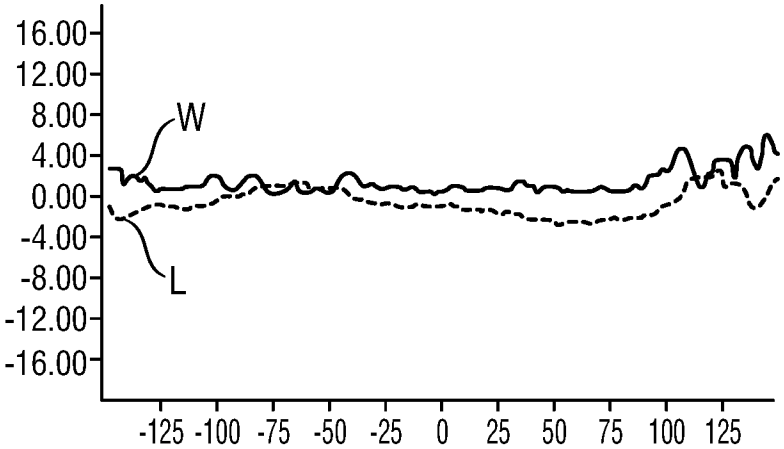
FIG. 4 shows the nanotopography parameters "waviness" (W) and "local warp" (L) of a semiconductor wafer made in accordance with an embodiment of the present invention.

FIG. 4 shows as an example the nanotopography parameters "waviness" (W) and "local warp" (L) for a semiconductor wafer having a diameter of 300 mm, which was produced with the method according to the invention by wire sawing from a crystal made of semiconductor material.

The changes of the "waviness" (W) and the "local warp" (L) in FIG. 3 and FIG. 4 are represented in a normalized fashion (without units) for better representation, the same normalization having been used for both figures.

FIGS. 3 and 4 represent the "local warp" (L) as a measure of the curvature of the wafer in the saw forward feed direction, and the "waviness" (W), which is derived from the "local warp" (L) by placing a moving window with a window length of 10 mm over the local warp curve and plotting the respective maximum deviations within this window.

The "local warp" (L) represented in FIG. 3 is characteristic of a wafer when the temperature of the crystal 3 is controlled during the cutting by supplying a coolant 4 onto the crystal lateral face 10, the coolant 4 having had a temperature profile applied to it so that the crystal 3 is at a substantially constant temperature during the cutting. The coolant 4 in this case flows unimpeded over the crystal 3 onto the wire sections 6 of the wire web, where it is mixed with the cutting suspension 12 and affects the mechanical and thermal properties of the wire sections 6 of the wire web.

The geometry measurement in FIG. 3 shows a clearly detrimental effect caused by this on the sawed wafer made of semiconductor material. This perturbing effect is in particular greatest from the middle of the wafer (large decrease of the "local warp" (L) from about position +35 mm), since the angle between the crystal side face 10 and the wire web is less than 90 degrees here and a perturbing effect of stagnation of the cutting suspension 12 occurs, which is further exacerbated by the coolant 4.

FIG. 4 shows for comparison a wafer made of semiconductor material which was sawed under the same conditions but by using a method according to an embodiment of the invention. Owing to the lateral removal of the coolant 4, no detrimental effect on the cutting behavior of the wire web occurs and a substantially straight cutting profile is ensured. With the method according to the invention, a reduction of the "local warp" (L) by more than 65% can be achieved.

The method according to the invention is suitable for all workpieces to be wire-sawed, regardless of the diameter.

The method according to the invention is preferably used for crystals having a diameter of more than 200 mm.

The method according to the invention is particularly preferably used for crystals having a diameter greater than or equal to 300 mm.

While the invention has been particularly shown and described with reference to preferred embodiments thereof, it will be understood by those skilled in the art that various changes in form and details may be made therein without departing from the spirit and scope of the invention.

What is claimed is:

1. A method for cooling a cylindrical workpiece during wire sawing, the workpiece being made of semiconductor material having a surface including two end faces and a lateral face, the method comprising:

sawing the workpiece with a wire saw including a wire web having wire sections arranged in parallel by penetrating the wire sections into the workpiece by an oppositely directed relative movement of the wire sections and the workpiece;

disposing wipers so as to bear on a surface of the workpiece;

controlling the temperature of the workpiece during the wire sawing using a liquid coolant applied onto the workpiece above the wipers bearing on the workpiece surface so as to remove the liquid coolant with the wipers bearing on the workpiece surface wherein the wire sections of the wire web penetrate into the workpiece below the wipers bearing on the workpiece surface.

2. The method recited in claim 1, wherein the wipers bear on the lateral face of the workpiece and the liquid coolant is applied onto the lateral face of the workpiece above the wipers.

3. The method recited in claim 1, wherein the wipers bear on the end faces of the workpiece and the liquid coolant is applied on to the end faces of the workpiece above the wipers.

4. The method recited in claim 1, wherein the wipers bear on at least one of the lateral face and the end face during the sawing until the wire sections of the wire web that are penetrating the workpiece reach a freely selectable penetration depth of the wire web into the workpiece, and the method further comprising ending the application of the liquid coolant upon reaching the penetration depth and removing the wipers from the workpiece surface.

5. The method recited in claim 1, further comprising applying a cutting suspension on the wire sections of the saw web, the cutting suspension including loose abrasives.

6. The method recited in claim 5, wherein the cutting suspension includes glycol as a carrier material.

7. The method recited in claim 5, wherein the cutting suspension includes a carrier medium, and wherein the liquid coolant includes the carrier medium.

8. The method recited in claim 1, wherein the wire sections include firmly bound abrasives.

* * * * *